US010270195B2

(12) United States Patent
Hayashi et al.

(10) Patent No.: US 10,270,195 B2
(45) Date of Patent: Apr. 23, 2019

(54) CONNECTOR

(71) Applicant: JAPAN AVIATION ELECTRONICS INDUSTRY, LIMITED, Shibuya-ku, Tokyo (JP)

(72) Inventors: Toshikazu Hayashi, Tokyo (JP); Masakazu Kuroiwa, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/029,924

(22) Filed: Jul. 9, 2018

(65) Prior Publication Data

US 2019/0089080 A1 Mar. 21, 2019

(30) Foreign Application Priority Data

Sep. 20, 2017 (JP) ..... 2017-179852

(51) Int. Cl.

| | |
|---|---|
| ***H01R 13/40*** | (2006.01) |
| ***H01R 13/11*** | (2006.01) |
| ***H01R 13/422*** | (2006.01) |
| *H01R 4/18* | (2006.01) |

(52) U.S. Cl.

CPC ..... *H01R 13/11* (2013.01); *H01R 13/422* (2013.01); *H01R 4/185* (2013.01)

(58) Field of Classification Search

CPC ..... H01R 13/11; H01R 13/422; H01R 4/185
USPC ..... 439/733.1, 752, 752.5
See application file for complete search history.

(56) References Cited

U.S. PATENT DOCUMENTS

| | | | | |
|---|---|---|---|---|
| 5,716,232 | A | 2/1998 | Endo et al. | |
| 8,366,494 | B2 * | 2/2013 | Nishide | H01R 13/113 439/752.5 |
| 8,388,388 | B2 * | 3/2013 | Suzuki | H01R 13/113 439/752.5 |
| 2012/0220173 | A1 * | 8/2012 | Mizutani | H01R 13/113 439/752.5 |
| 2013/0295791 | A1 | 11/2013 | Kutsuna | |

FOREIGN PATENT DOCUMENTS

| | | | |
|---|---|---|---|
| JP | 2004134109 | A | 4/2004 |
| JP | 2010003465 | A | 1/2010 |
| JP | 2011086388 | A | 4/2011 |
| JP | 2012028149 | A | 2/2012 |
| JP | 2013197073 | A | 9/2013 |
| JP | 2014026763 | A | 2/2014 |
| WO | 2012095921 | A1 | 7/2012 |

OTHER PUBLICATIONS

Extended European Search Report (EESR) dated Feb. 14, 2019 issued in counterpart European Application No. 18188035.2.

* cited by examiner

*Primary Examiner* — Khiem Nguyen
(74) *Attorney, Agent, or Firm* — Holtz, Holtz & Volek PC

(57) ABSTRACT

A connector is provided with a female contact and a housing. A protection portion of the female contact has a guide portion intersecting with a front-rear direction to guide a male contact to a receiving portion. An insertion opening of the housing is located forward of a contact accommodation portion in the front-rear direction. The insertion opening opens in a predetermined direction perpendicular to the front-rear direction and thereby communicates with an aperture portion. When a front of the connector is viewed along the front-rear direction, the guide portion is visible through the insertion opening at least in part.

11 Claims, 8 Drawing Sheets

CONNECTOR

CROSS REFERENCE TO RELATED APPLICATIONS

This application is based on and claims priority under 35 U.S.C. § 119 to Japanese Patent Application No. JP2017-179852 filed Sep. 20, 2017, the contents of which are incorporated herein in their entireties by reference.

BACKGROUND OF THE INVENTION

This invention relates to a connector, particularly, to a connector which is provided with a female contact having a protection portion.

Referring to FIG. 13, a connector 90 described in JPA 2004-134109 (Patent Document 1) is provided with a plurality of contacts (or female contacts) 92 and an insulator (or a housing) 94 holding the contacts 92. The insulator 94 has contact accommodation portions 942, which are used to accommodate the contacts 92, respectively, and a guide wall surface 944 located forward of each of the contact accommodation portions 942. The guide wall surface 944 is formed with a guide hole (or an insertion opening) 946 which allows a mating contact (or a male contact) 96 to be inserted into the contact accommodation portion 942.

As shown in FIG. 14, the contact 92 has a tubular contact portion (or a body portion) 922 with a cross-sectional shape of an approximately square. As understood from FIG. 13, the contact portion 922 has a receiving portion 924 which receives the mating contact (or the male contact) 96. In the receiving portion 924, a contact spring piece 926 is provided to serve as both of a contact point and a supporting portion supporting the contact point.

As understood from FIG. 13, upon assembling, the contact 92 is moved forward from behind the insulator 94 and inserted into the contact accommodation portion 942. The contact 92, as shown in the lowest part of FIG. 13, is pushed into the contact accommodation portion 942 until it is brought into abutment with the guide wall surface 944. An upper front portion of the contact portion 922 of the contact 92 is provided with a protection portion 928. The protection portion 928 prevents the contact spring piece 926 from being brought into abutment with the guide wall surface 944 of the insulator 94 or other parts and deforming when the contact 92 is inserted into the contact accommodation portion 942.

SUMMARY OF THE INVENTION

In the connector 90 of Patent Document 1, the guide hole 946 formed in the guide wall surface 944 of the insulator 94 is closed in a plane perpendicular to a front-rear direction. In other words, the insulator 94 adopts the closed entry structure. Therefore, there is a possibility that the mating contact 96 cannot be inserted into the receiving portion 924 of the contact 92 when a positional difference is caused between the guide hole 946 and the receiving portion 924 of the contact 92 by, for example, manufacturing variation.

Therefore, it is an object of the present invention to provide a connector in which ease of insertion of a male contact into a receiving portion of its female contact is improved.

Specifically, the present invention makes a part, which corresponds to a protection portion of a female contact (or a contact), of walls defining an insertion opening (or a guide hole) open. In addition, the present invention provides a guide portion to the protection portion and guides a male contact into a receiving portion of the female contact so that the protection portion does not obstruct, in the aforementioned part, insertion of the male contact into the receiving portion of the female contact.

One aspect of the present invention provides a connector which comprises a female contact and a housing holding the female contact. The female contact has a body portion, a contact point, a supporting portion and a protection portion. The body portion has a receiving portion opening forward in a front-rear direction to receive a male contact along the front-rear direction. The contact point is located in the receiving portion. The supporting portion supports the contact point. The protection portion is located forward of the supporting portion in the front-rear direction and protects the supporting portion in part. The protection portion has a guide portion which is to guide the male contact to the receiving portion and intersects with the front-rear direction. The housing has an accommodation portion, an insertion opening and an aperture portion. The accommodation portion accommodates the female contact. The insertion opening is located forward of the accommodation portion in the front-rear direction and communicates with the accommodation portion. The insertion opening opens in a predetermined direction perpendicular to the front-rear direction and thereby communicates with the aperture portion. When a front of the connector is viewed along the front-rear direction, the guide portion is visible through the insertion opening at least in part.

According to the present invention, the insertion opening of the housing opens in the predetermined direction. In addition, the guide portion is formed to the protection portion of the female contact, and at least a part thereof is exposed in the insertion opening. As a result, the male contact is guided by the guide portion of the female contact without influence of a positional difference between the insertion opening of the housing and an opening of the receiving portion of the female contact. Therefore, ease of insertion of the male contact into the receiving portion of the female contact is improved.

An appreciation of the objectives of the present invention and a more complete understanding of its structure may be had by studying the following description of the preferred embodiment and by referring to the accompanying drawings.

4.

Figure 4:
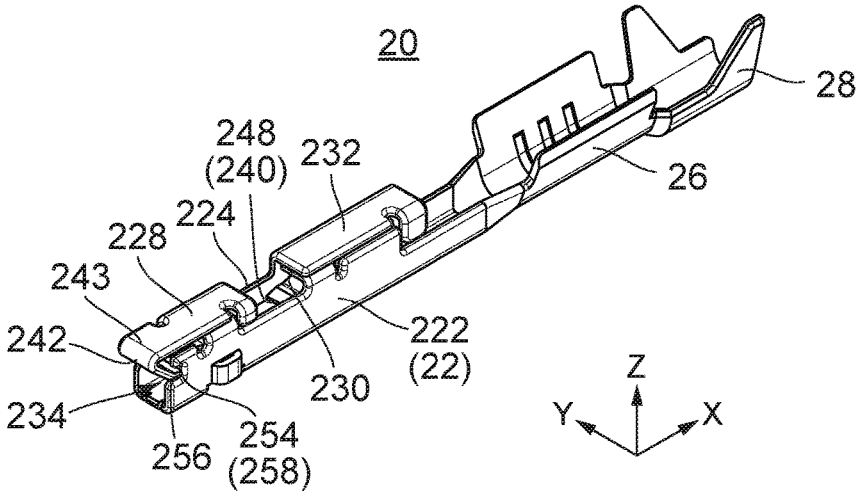
FIG. 4 is a front, upper-right, perspective view showing the female contact included in the connector of FIG. 1.
Figure 8:
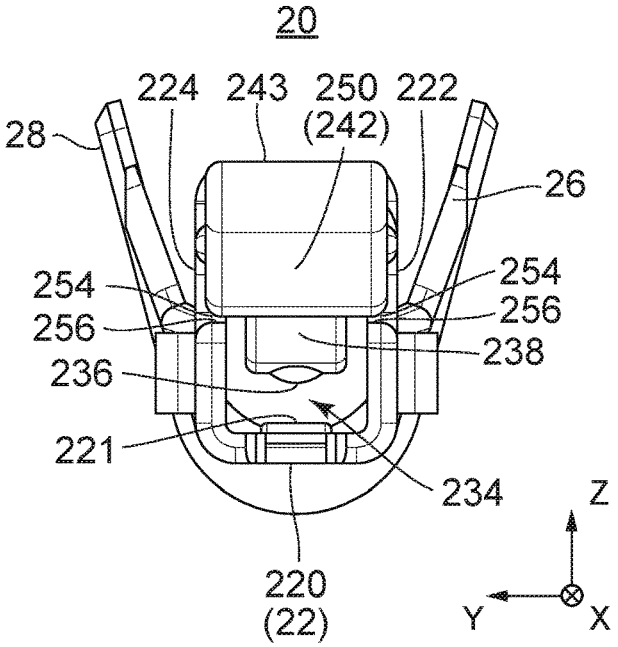

FIG. 8 is a front view showing the female contact of FIG. 4.

Figure 9:
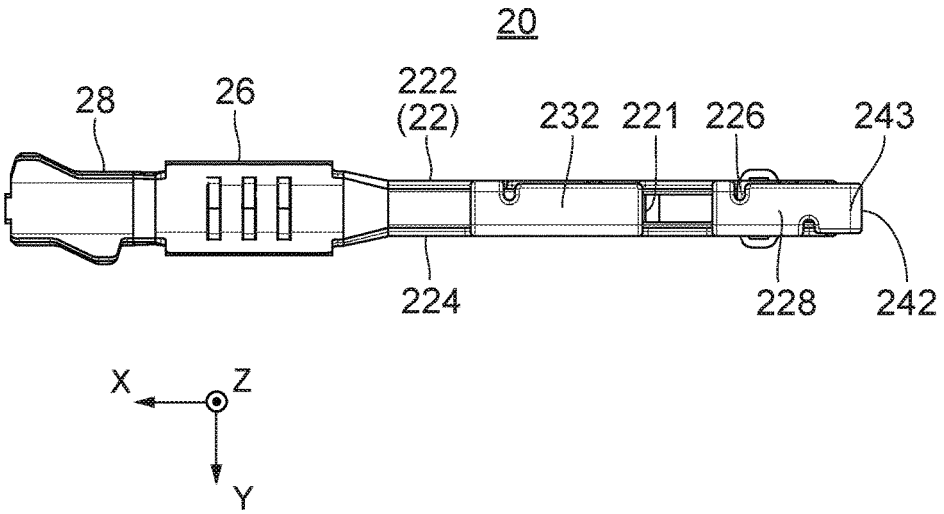

FIG. 9 is a plan view showing the female contact of FIG. 4.

Figure 10:
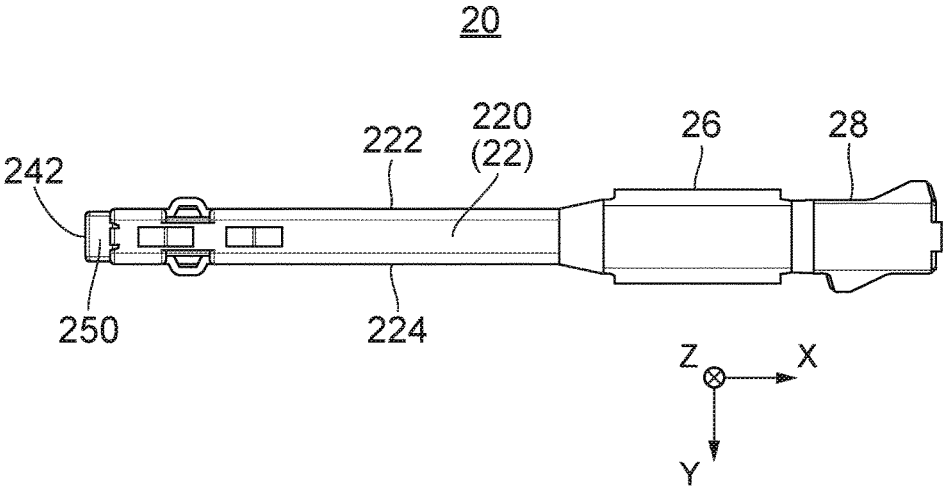

FIG. 10 is a bottom view showing the female contact of FIG. 4.

Figure 11:
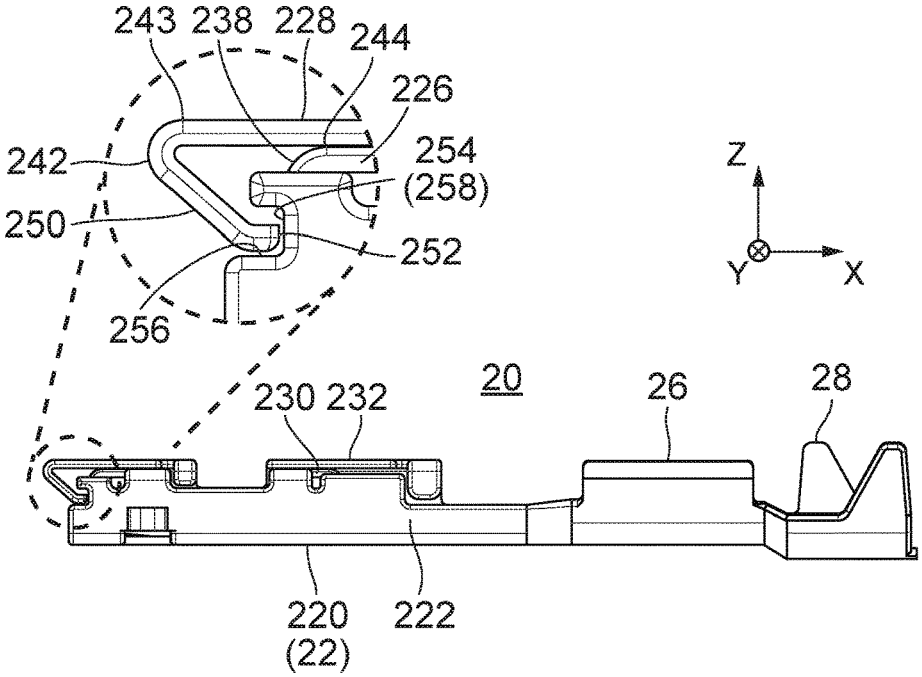

FIG. 11 is a right side view showing the female contact of FIG. 4. An area circled by a broken line is enlarged and illustrated.

Figure 12:
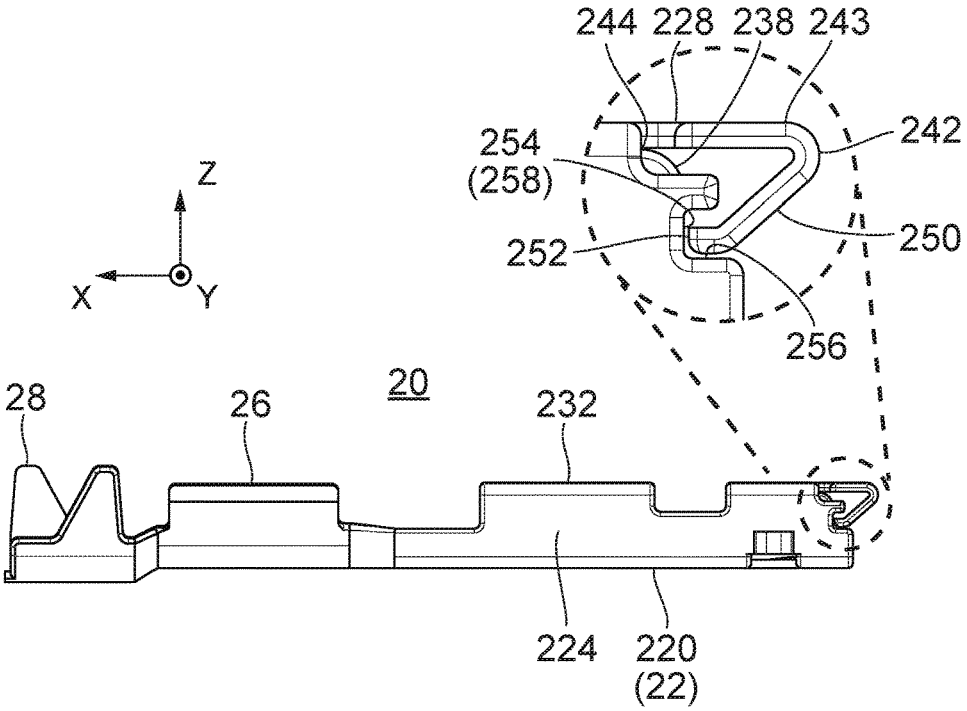

FIG. 12 is a left side view showing the female contact of FIG. 4. An area circled by a broken line is enlarged and illustrated.

Figure 13:
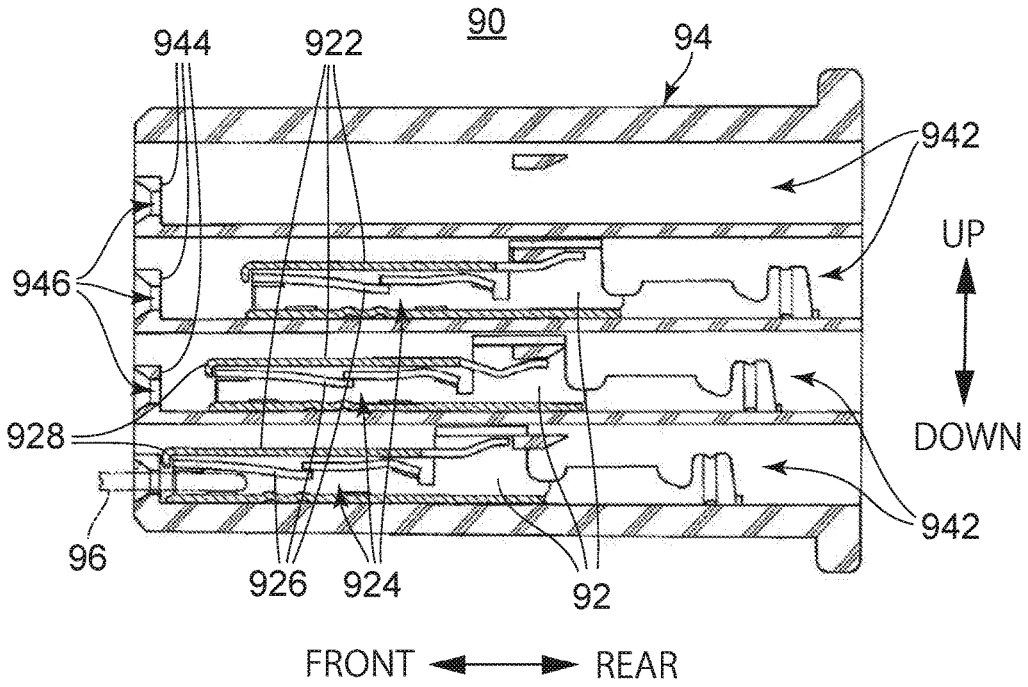
FIG. 13 PRIOR ART

FIG. 13 is a cross-sectional view showing a connector described in Patent Document 1. Three contacts are inserted in contact accommodation portions of a housing. Upper two of the contacts are in the middle of being accommodated while the lowermost contact has been accommodated.

Figure 14:
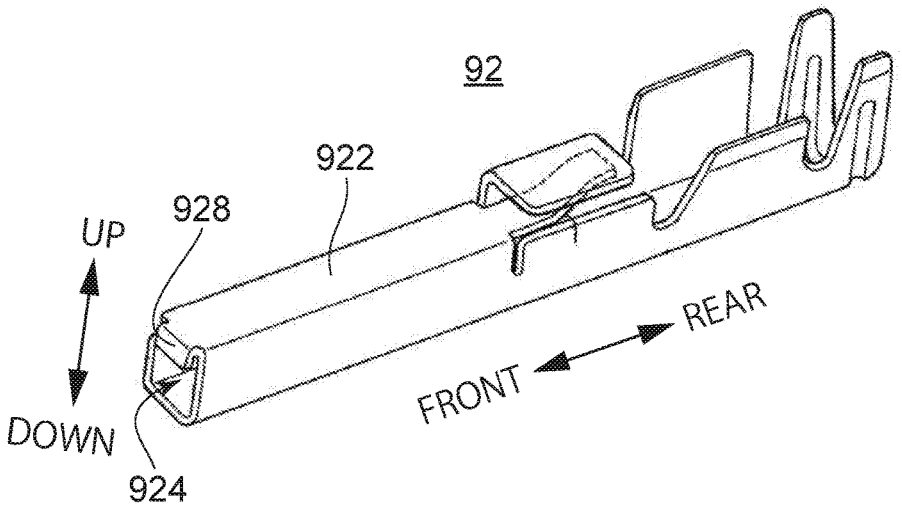
FIG. 14 PRIOR ART

FIG. 14 is a perspective view showing the contact included in the connector of FIG. 13.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 1:
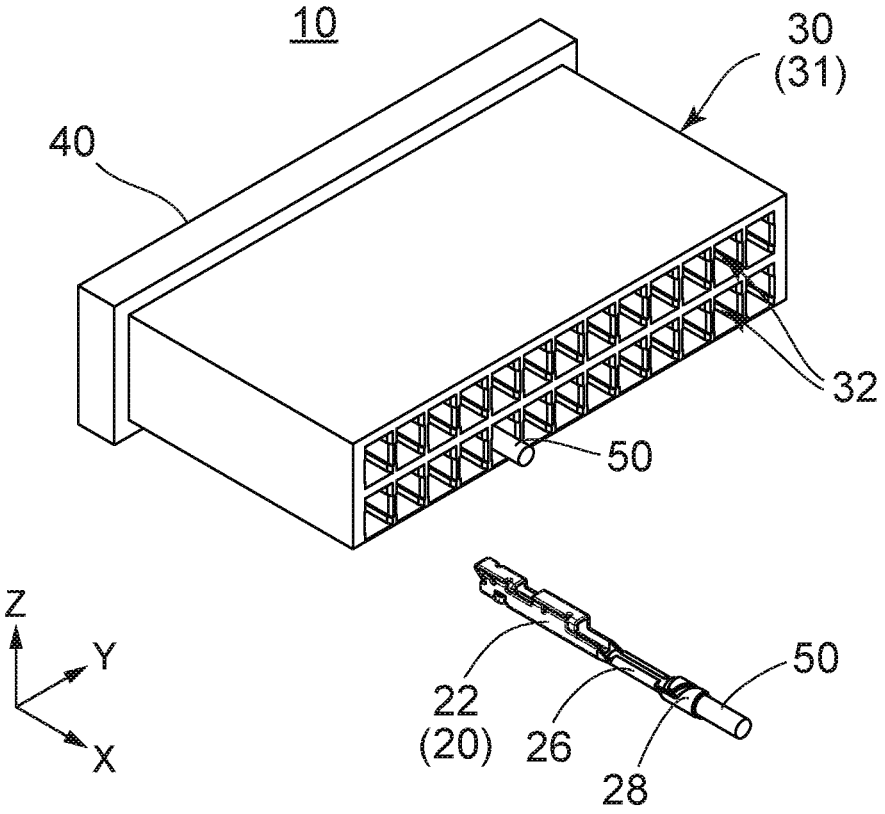
FIG. 1 is a perspective view showing a connector according to an embodiment of the present invention. A housing holds a female contact. Another female contact is not yet held by the housing.

Referring to FIG. 1, a connector 10 according to an embodiment of the present invention is provided with at least one female contact 20 and a housing 30. In the present embodiment, the housing 30 has a housing body 31 and a front insulator 40. However, the present invention is not limited thereto. The housing 30 may consist of only the housing body 31. In the present embodiment, the female contact 20 is made of metal, and the housing body 31 and the front insulator 40 are made of insulating resin. As understood from FIG. 1, the female contact 20 is attached to an end of a cable 50 and held by the housing 30.

As shown in FIG. 1, the housing body 31 has a plurality of contact accommodation portions (accommodation portions) 32 which are used to accommodate the female contacts 20, respectively. The contact accommodation portions 32 open rearward in a front-rear direction. In the present embodiment, the front-rear direction is an X-direction. A negative X-direction is directed forward while a positive X-direction is directed rearward. The contact accommodation portions 32 are arranged in two rows juxtaposed with each other in an up-down direction. In the present embodiment, the up-down direction is a Z-direction. A positive Z-direction is directed upward while a negative Z-direction is directed downward. In each of the rows, the contact accommodation portions 32 are arranged along a lateral direction perpendicular to both of the front-rear direction and the up-down direction. In the present embodiment, the lateral direction is a Y-direction. As understood from FIG. 1, upon assembling, the female contacts 20 are moved forward from behind the housing body 31 and inserted into the contact accommodation portions 32 to be accommodated therein. Thus, the housing body 31 (the housing 30) holds the female contacts 20.

As shown in FIG. 1, in the present embodiment, the contact accommodation portions 32 are twenty-six in number. However, the present invention is not limited thereto. The housing body 31 may have at least one contact accommodation portion 32. In most instances, the contact accommodation portions 32 are equal to the female contacts 20 in number. However, the contact accommodation portions 32 may be larger than the female contacts 20 in number. In other words, the housing body 31 may hold the female contacts 20 of required numbers according to application of the connector 10. Though the contact accommodation portions 32 are arranged in the two rows in the present embodiment, the present invention is not limited thereto. The contact accommodation portions 32 may be arranged in a single row or three or more rows.

As shown in FIG. 1, the front insulator 40 is attached to the housing body 31. In detail, the front insulator 40 is attached to a front portion of the housing body 31. As described later, the front insulator 40 covers aperture portions 360 (see FIGS. 2 and 3) of the housing body 31 in part. As understood from FIG. 2, in the present embodiment, the front insulator 40 forms a horizontal lattice when a front thereof is viewed along the front-rear direction.

Referring to FIGS. 4 to 7, the female contact 20 has a body portion 22, a wire barrel portion 26 and an insulation barrel portion 28. The body portion 22, the wire barrel portion 26 and the insulation barrel portion 28 are in a line in this order along the front-rear direction. The body portion 22 is a part used to be connected to a male contact (not shown). The wire barrel portion 26 and the insulation barrel portion 28 are a connection portion used to be connected to the cable 50 (see FIG. 1). In detail, the wire barrel portion 26 is crimped to a core wire of the cable 50, and the insulation barrel portion 28 is crimped to a part, the core wire of which is covered with a sheath portion, of the cable 50. In the present embodiment, the female contact 20 is formed by punching out and bending a metal sheet.

As shown in FIGS. 4 to 12, the body portion 22 of the female contact 20 has a bottom plate portion (a bottom wall) 220, a pair of side plate portions (side walls) 222 and 224, an inner front top plate portion 226, an outer front top plate portion 228, an inner rear top plate portion 230 and an outer rear top plate portion 232.

As shown in FIG. 10, the bottom plate portion 220 has an approximately rectangular shape long in the front-rear direction. The bottom plate portion 220 has side edges at both ends thereof in the lateral direction. As understood from FIGS. 4 and 8, the side plate portions 222 and 224 extend from the side edges of the bottom plate portion 220 along a predetermined direction. In the present embodiment, the predetermined direction is the up-down direction perpendicular to both of the front-rear direction and the lateral direction. In other words, the side plate portions 222 and 224 extend along the up-down direction and face each other in the lateral direction.

Figure 5:
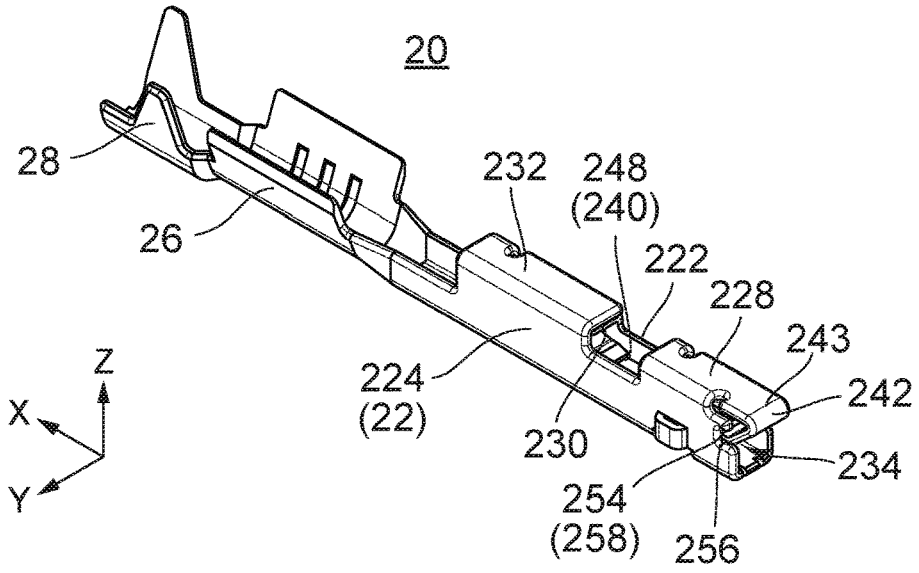
FIG. 5 is a front, upper-left, perspective view showing the female contact of FIG. 4.
Figure 6:
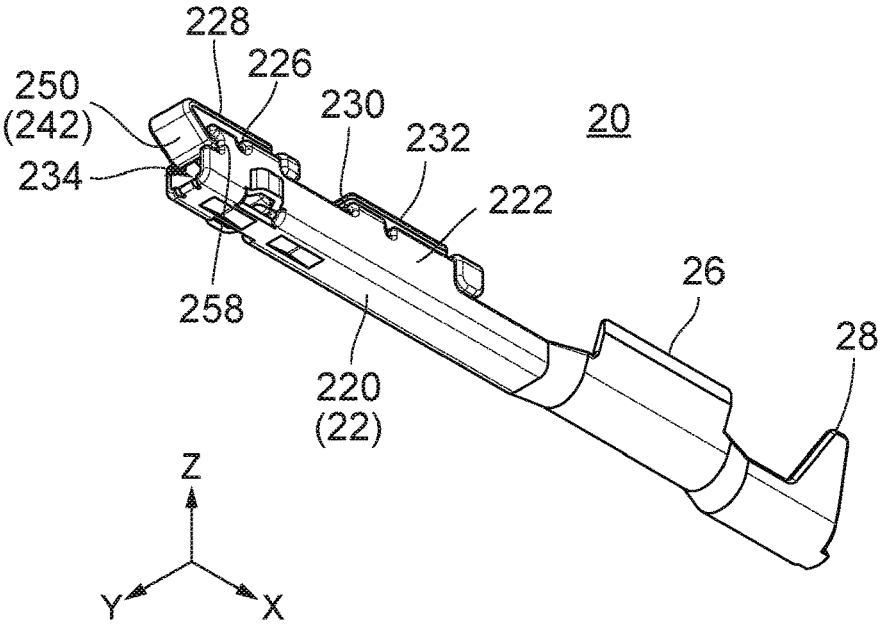
FIG. 6 is a front, lower-right, perspective view showing the female contact of FIG. 4.
Figure 7:
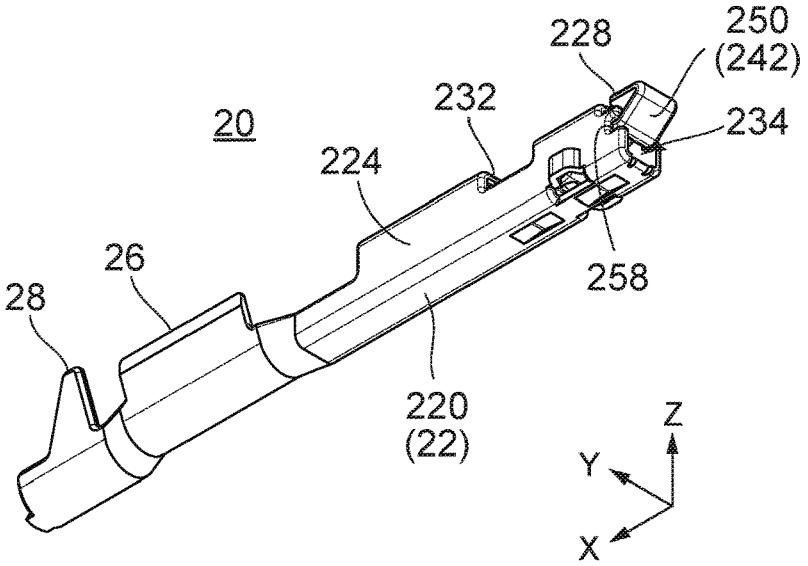
FIG. 7 is a front, lower-left, perspective view showing the female contact of FIG.

As understood from FIGS. 4 to 6, the inner rear top plate portion 230 extends from an upper end of the side plate portion 222. Just like the inner rear top plate portion 230, the inner front top plate portion 226 extends from the upper end of the side plate portion 222. As understood from FIG. 2, each of the inner front top plate portion 226 and the inner rear top plate portion 230 has a rectangular shape long in the front-rear direction. Referring again to FIGS. 4 to 6, a rear side edge portion of the inner front top plate portion 226 is continued from the upper end of the side plate portion 222 while a front side edge portion of the inner rear top plate portion 230 is continued from the upper end of the side plate portion 222.

As shown in FIGS. 4 and 5, the outer front top plate portion 228 and the outer rear top plate portion 232 extend from an upper end of the side plate portion 224. Each of the outer front top plate portion 228 and the outer rear top plate portion 232 has an approximately rectangular shape long in the front-rear direction. The outer front top plate portion 228 is longer than the inner front top plate portion 226 (see FIG. 6) in the front-rear direction. The outer front top plate portion 228 is located above the inner front top plate portion 226 in the up-down direction and covers the inner front top plate portion 226. The outer rear top plate portion 232 is slightly longer than the inner rear top plate portion 230 in the front-rear direction. The outer rear top plate portion 232 is located above the inner rear top plate portion 230 in the up-down direction and covers the inner rear top plate portion 230.

Figure 2:
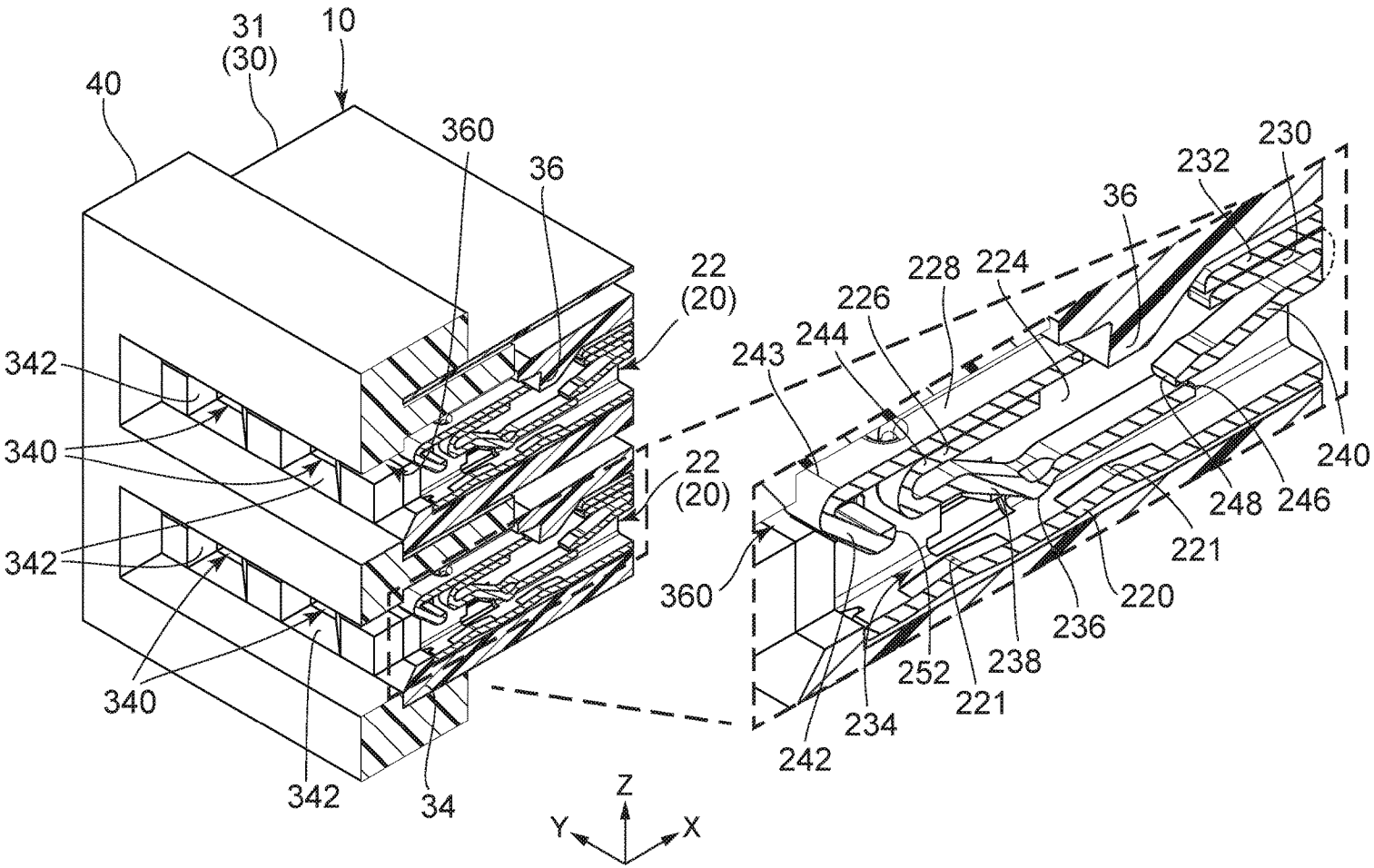
FIG. 2 is a partial, cross-sectional, perspective view showing the connector of FIG. 1. The housing holds the two female contacts. A quadrangle area surrounded by a broken-line is enlarged and illustrated. In the enlarged view, a part of a supplementary spring portion of the female contact is drawn by a dashed line.

Referring to FIG. 2 in addition to FIGS. 4 to 12, the bottom plate portion 220, the side plate portions 222 and 224, the inner front top plate portion 226, the outer front top plate portion 228, the inner rear top plate portion 230 and the outer rear top plate portion 232 define a receiving portion 234. The receiving portion 234 opens forward in the front-rear direction to receive the male contact (not shown) along the front-rear direction. Thus, the body portion 22 has the receiving portion 234.

Referring to FIG. 2, the female contact 20 further has a contact point 236, a supporting portion 238, a supplementary spring portion 240 and a protection portion 242.

As shown in FIG. 2, the contact point 236 is located in the receiving portion 234. In addition, the contact point 236 faces the bottom plate portion 220 in the up-down direction. In other words, the bottom plate portion 220 faces the contact point 236 in the predetermined direction. The contact point 236 is formed to the supporting portion 238 by a press process. The supporting portion 238 supports the contact point 236. In detail, the supporting portion 238 supports the contact point 236 so that the contact point 236 is located in the receiving portion 234 and faces the bottom plate portion 220. In more detail, the supporting portion 238 has a fixed end 244 and a free end 246 which is located rearward of the fixed end 244 in the front-rear direction. The fixed end 244 coincides with a front end of the inner front top plate portion 226. The supporting portion 238 extends downward from the fixed end 244 to draw an arc, extends rearward therefrom, extends further backward-diagonally downward, and then extends further rearward. The supporting portion 238 has resilience, and the free end 246 thereof is movable at least in the up-down direction. The contact point 236 is located between the fixed end 244 and the free end 246 of the supporting portion 238 and movable at least in the up-down direction owing to resilient deformation of the supporting portion 238. However, the present invention is not limited thereto. The contact point 236 may be provided to the free end 246 of the supporting portion 238.

As shown in FIG. 2, the bottom plate portion 220 is formed with a pair of supplementary contact points 221 protruding in the receiving portion 234. The contact point 236 is located between the supplementary contact points 221 in the front-rear direction. The male contact (not shown) received by the receiving portion 234 is brought into contact with the contact point 236 to deform resiliently the supporting portion 238. Then, the contact point 236 pushes the male contact toward the bottom plate portion 220 according to a reaction force of the supporting portion 238. Thus, the male contact received by the receiving portion 234 is brought into contact with the contact point 236 and the supplementary contact points 221 and electrically connected to the female contact 20.

As shown in FIG. 2, the supplementary spring portion 240 extends downward from a rear end of the inner rear top plate portion 230 to draw an arc, extends forward therefrom, extends further forward-diagonally downward, and then extends further forward. A free end 248 of the supplementary spring portion 240 and its vicinity are located above the vicinity of the free end 246 of the supporting portion 238. The supplementary spring portion 240 has resilience. When the free end 246 of the supporting portion 238 is moved upward, the supplementary spring portion 240 is brought into contact with the free end 246 or therearound to suppress the movement of the free end 246. Consequently, large deformation of the supporting portion 238 is prevented, and plastic deformation of the supporting portion 238 is prevented. In the present embodiment, the free end 248 of the supplementary spring portion 240 and its vicinity are brought into contact with the supporting portion 238. However, the present invention is not limited thereto. The supplementary spring portion 240 may be brought into contact with the supporting portion 238 at a plurality of points or areas. For example, the supplementary spring portion 240 may be brought into contact with the supporting portion 238 at two points which are located forward and rearward of the contact point 236, respectively, in the front-rear direction. This can be accomplished by changing the shape of the supplementary spring portion 240 into a waveform.

As shown in FIGS. 2 and 4 to 7, the protection portion 242 extends from the body portion 22 toward the inside of the receiving portion 234. In the present embodiment, the protection portion 242 extends from an upper portion of the body portion 22, or a front end of the outer front top plate portion 228, toward the inside of the receiving portion 234. In detail, as shown in FIGS. 11 and 12, the protection portion 242 is formed by bending a plate-like portion which has a rectangular shape and extends from the front end of the outer front top plate portion 228 or a boundary part 243. The protection portion 242 extends from the front end of the outer front top plate portion 228 to draw an arc, extends backward-diagonally downward therefrom, and then extends further rearward. In the present embodiment, the protection portion 242 extends from the outer front top plate portion 228. However, the present invention is not limited thereto. The protection portion 242 may extend from either one of the side plate portions 222 and 224 toward the inside of the protection portion 242. However, considering easiness of its manufacture and its functional stability, it is preferable that the protection portion 242 extends from the outer front top plate portion 228. Moreover, though an end portion 252 of the protection portion 242 is directed rearward in the present embodiment, the end portion 252 may be directed rearward-diagonally downward.

As understood from FIGS. 2, 11 and 12, the protection portion 242 is located forward of the supporting portion 238 in the front-rear direction. As understood from FIGS. 2 and 3, the protection portion 242 hides the supporting portion 238 in part and protects it. In detail, the protection portion 242 is located forward of the fixed end 244 of the supporting portion 238 in the front-rear direction. When a front of the connector 10 is viewed along the front-rear direction, the protection portion 242 covers the whole of the fixed end 244 of the supporting portion 238. In a case where a part of the supporting portion 238 is located forward of the fixed end 244 like the present invention, the protection portion 242 also protects the part of the supporting portion 238.

As shown in FIGS. 6 to 8 and 10 to 12, the protection portion 242 has a guide portion 250 for guiding the male contact (not shown) to the receiving portion 234. In the present embodiment, the guide portion 250 is a flat surface intersecting with the front-rear direction. In detail, the guide portion 250 is the flat surface intersecting obliquely with the front-rear direction. In the present embodiment, the guide portion 250 is directed forward-diagonally downward. However, the present invention is not limited thereto. The guide portion 250 may consist of a curved surface or a combination of a flat surface and a curved surface.

As shown in FIGS. 11 and 12, the body portion 22 has first regulating portions 254 for regulating rearward movement of the end portion 252 of the protection portion 242 in the front-rear direction. Furthermore, the body portion 22 has second regulating portions 256 for regulating movement of the end portion 252 of the protection portion 242 toward the bottom plate portion 220. The first regulating portions 254 are formed in the side plate portions 222 and 224, respectively. Similarly, the second regulating portions 256 are formed in the side plate portions 222 and 224, respectively. In detail, notches 258 are formed in the side plate portions 222 and 224, respectively, and each of notches 258 forms a set of the first regulating portion 254 and the second regulating portion 256.

Figure 3:
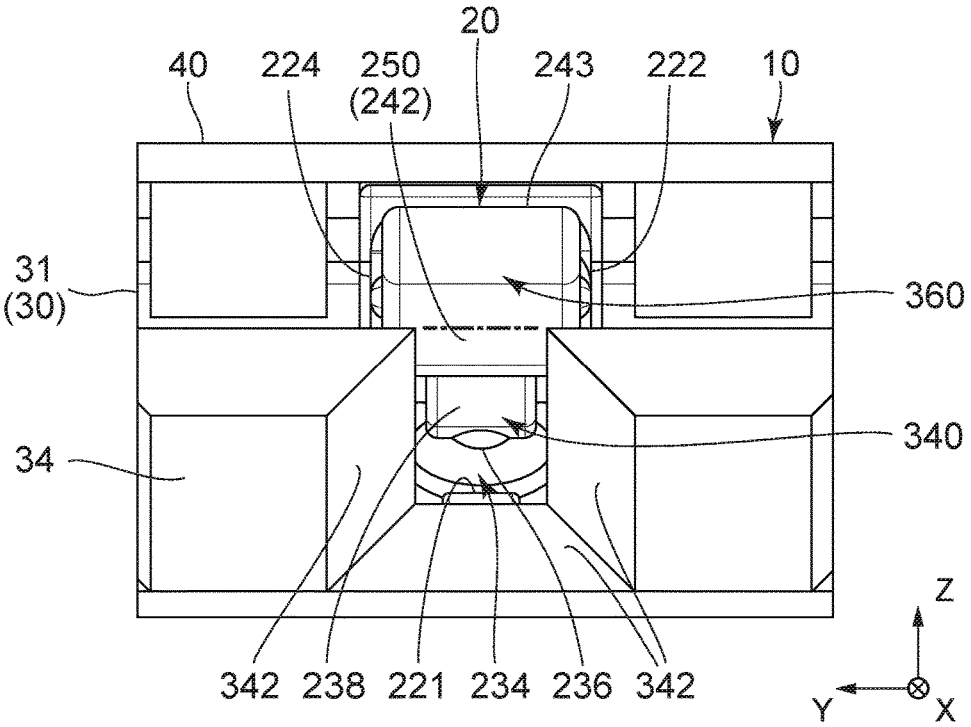
FIG. 3 is a partial front view showing the connector of FIG. 1. It shows a part, which corresponds to one of contact accommodation portions, of the housing. The contact accommodation portion accommodates the female contact. A dashed line indicates a boundary between an aperture portion and an insertion opening.

As understood from FIGS. 2 and 3, the housing body 31 has a front wall 34 defining a front end of the contact accommodation portions 32 (see FIG. 1). The front wall 34 is formed with insertion openings 340 communicating with the contact accommodation portions 32. In other words, the housing body 31 has the insertion openings 340 communicating with the contact accommodation portions 32. Each of the insertion openings 340 is located forward of the contact accommodation portion 32 corresponding thereto in the front-rear direction. As shown in FIG. 3, in the present embodiment, the insertion opening 340 has a rectangular shape when viewed along the front-rear direction. However, the present invention is not limited thereto. When viewed along the front-rear direction, the shape of the insertion opening 340 may be a part of a circle, a part of an ellipse or a polygon.

As shown in FIG. 2, the housing body 31 further has lances 36 protruding into the contact accommodation portions 32 (see FIG. 1) in part. Each of the lances 36 is resiliently deformable to allow the female contact 20 to be accommodated in the contact accommodation portion 32 corresponding thereto. On the other hand, the lance 36 regulates rearward movement of the female contact 20 if once the female contact 20 reaches a predetermined position in the contact accommodation portion 32. A part of a front end of the body portion 22 of the female contact 20 is brought into abutment with the front wall 34 and thereby it can be known that the female contact 20 reaches the predetermined position in the contact accommodation portion 32. Thus, the female contacts 20 are held by the housing body 31. The housing body 31 has the aperture portions 360 which are inevitably formed due to the formation of the lances 36. Each of the aperture portions 360 communicates with the contact accommodation portion 32 corresponding thereto at least in part.

As shown in FIG. 3, the insertion opening 340 of the housing body 31 opens in a predetermined direction perpendicular to the front-rear direction and communicates with the aperture portion 360. The predetermined direction depends on a location of the protection portion 242 of the female contact 20. In other words, the insertion opening 340 opens at a location corresponding to the protection portion 242. In the present embodiment, the predetermined direction is an upward direction. That is, in the present embodiment, the insertion opening 340 opens upward to communicate with the aperture portion 360.

As understood from FIGS. 2 and 3, the insertion opening 340 of the housing body 31 is formed with a taper portion 342 for guiding the male contact (not shown). In the present embodiment, the taper portion 342 occupies from a front end of the insertion opening 340 to a middle portion of the insertion opening 340 in the front-rear direction. However, the present invention is not limited thereto. The taper portion 342 may be formed from the front end of the insertion opening 340 to a rear end of the insertion opening 340. In the present invention, the taper portion 342 consists of three flat surfaces. However, the present invention is not limited thereto. The taper portion 342 may consist of a curved surface or a combination of a flat surface(s) and a curved surface(s). Moreover, the taper portion 342 is not always necessary but may be omitted.

As shown in FIG. 3, when the front of the connector 10 is viewed along the front-rear direction, the protection portion 242 is visible through the aperture portion 360 at least in part. At this time, the boundary part 243 between the protection portion 242 and the body portion 22 is also visible through the aperture portion 360. Since the protection portion 242 is visible through the aperture portion 360 in this way, it can be easy to bring a test jig into contact with the female contact 20 therethrough, wherein the test jig is used to carry out a short circuit test or the like for the female contact 20. It is noted that such a test can be carried out even in a state that the front insulator 40 is detached. Detaching the front insulator 40 makes the test more easily.

As shown in FIG. 3, when the front of the connector 10 is viewed along the front-rear direction, the protection portion 242 is visible through not only the aperture portion 360 but also the insertion opening 340. In detail, when the front of the connector 10 is viewed along the front-rear direction, the guide portion 250 is visible through the insertion opening 340 at least in part. At this time, the guide portion 250 is viewed to overlap the taper portion 342 in part. Though the guide portion 250 hides the supporting portion 238 in part, it does not hide the contact point 236. In other words, through the insertion opening 340, the contact point 236 located in the receiving portion 234 and a part of the supporting portion 238 supporting the contact point 236 are visible. Furthermore, through the insertion opening 340, the supplementary contact point 221 is also visible.

As understood from FIG. 3, the guide portion 250 and the taper portion 342 form a structure similar to the closed entry structure. Accordingly, the guide portion 250 and the taper portion 342 guide the male contact (not shown) toward the inside of the receiving portion 234 when the male contact is inserted into the insertion opening 340. The guide portion 250 guides the male contact toward the inside of the receiving portion 234 irrespective of a positional relationship between an opening of the receiving portion 234 and the insertion opening 340. Therefore, even when a positional gap exists between the opening of the receiving portion 234 and the insertion opening 340, the male contact is appropriately guided into the receiving portion 234. As a result, the male contact can be easily and certainly brought into contact with the contact point 236 and the supplementary contact points 221. Thus, according to the connector 10 of the present embodiment, ease of insertion of the male contact into the receiving portion 234 of the female contact 20 is improved.

As understood from FIGS. 2 and 3, the front insulator 40 hides the lance 36 in part when the front of the connector 10 is viewed along the front-rear direction, and it makes the lance 36 incapable of being operated. If it is necessary to operate the lance 36, the front insulator 40 should be detached from the housing body 31. Detaching the front insulator 40 from the housing body 31 enables to operate the lance 36 using a jig (not shown).

Although the specific explanation about the present invention is made above referring to the embodiment, the present invention is not limited thereto but susceptible of various modifications and alternative forms without departing from the spirit of the invention. For example, though the female contact 20 is formed of a single metal sheet in the aforementioned embodiment, the female contact 20 may consists of a plurality of parts. In such a case, the protection portion 242 may be formed separately from the body portion 22 to be attached to the body portion 22. Moreover, though the female contact 20 has the wire barrel portion 26 and the insulation barrel portion 28 in the aforementioned embodiment, the present invention is applicable to a female contact which does not have the insulation barrel portion 28 or which has a different connection portion with a different shape.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprising a female contact and a housing holding the female contact, wherein:

the female contact has a body portion, a contact point, a supporting portion and a protection portion;

the body portion has a receiving portion opening forward in a front-rear direction to receive a male contact along the front-rear direction;

the contact point is located in the receiving portion;

the supporting portion supports the contact point;

the protection portion is located forward of the supporting portion in the front-rear direction and protects the supporting portion in part;

the protection portion has a guide portion which is to guide the male contact to the receiving portion and intersects with the front-rear direction;

the housing has an accommodation portion, an insertion opening and an aperture portion;

the accommodation portion accommodates the female contact;

the insertion opening is located forward of the accommodation portion in the front-rear direction and communicates with the accommodation portion;

the insertion opening opens in a predetermined direction perpendicular to the front-rear direction and thereby communicates with the aperture portion; and when a front of the connector is viewed along the front-rear direction, the guide portion is visible through the insertion opening at least in part.

2. The connector as recited in claim 1, wherein:

the protection portion extends from the body portion toward an inside of the receiving portion; and the guide portion intersects obliquely with the front-rear direction.

3. The connector as recited in claim 2, wherein the protection portion intersects obliquely with the front-rear direction.

4. The connector as recited in claim 1, wherein:

the supporting portion has a fixed end and a free end located rearward of the fixed end in the front-rear direction;

the protection portion is located forward of the fixed end of the supporting portion in the front-rear direction; and when the front of the connector is viewed along the front-rear direction, the protection portion covers wholly the fixed end of the supporting portion.

5. The connector as recited in claim 1, wherein:

the protection portion has an end portion directed rearward in the front-rear direction; and the body portion has a first regulating portion to regulate a rearward movement of the end portion of the protection portion in the front-rear direction.

6. The connector as recited in claim 5, wherein:

the body portion has a bottom wall and a pair of side walls;

the bottom wall faces the contact point in the predetermined direction;

the bottom wall has side edges at both ends thereof in a lateral direction perpendicular to both of the front-rear direction and the predetermined direction;

the side walls extend from the side edges of the bottom wall along the predetermined direction to be opposite to each other in the lateral direction; and the first regulating portion is formed to each of the side walls.

7. The connector as recited in claim 6, wherein:

the body portion has a second regulating portion to regulate a movement of the end portion of the protection portion toward the bottom wall;

the second regulating portion is formed to each of the side walls; and the first regulating portion and the second regulating portion are formed of a notch produced in each of the side walls.

8. The connector as recited in claim 1, wherein:

the protection portion and the body portion form a boundary part therebetween; and when the front of the connector is viewed along the front-rear direction, the boundary part is visible through the aperture portion.

9. The connector as recited in claim 1, wherein the insertion opening is formed with a taper portion to guide the male contact.

10. The connector as recited in claim 1, wherein:

the predetermined direction is an up-down direction;

the insertion opening opens upward in the up-down direction;

the body portion has an upper portion; and the protection portion extends from the upper portion of the body portion toward an inside of the receiving portion in the up-down direction.

11. The connector as recited in claim 1, wherein the female contact is formed of a metal sheet.

* * * * *